US011090529B2

(12) United States Patent
Barrett

(10) Patent No.: US 11,090,529 B2
(45) Date of Patent: Aug. 17, 2021

(54) GOLF BALL WITH INDICIA

(71) Applicant: Triple Track, LLC, St. Louis, MO (US)

(72) Inventor: W. Raymond Barrett, St. Louis, MO (US)

(73) Assignee: Triple Track, LLC, St. Louis, MO (US)

( * ) Notice: Subject to any disclaimer, the term of this patent is extended or adjusted under 35 U.S.C. 154(b) by 0 days.

(21) Appl. No.: 16/938,094

(22) Filed: Jul. 24, 2020

(65) Prior Publication Data

US 2021/0038949 A1 Feb. 11, 2021

Related U.S. Application Data

(60) Provisional application No. 62/884,006, filed on Aug. 7, 2019.

(51) Int. Cl.

| | |
|---|---|
| ***A63B 37/06*** | (2006.01) |
| ***A63B 43/00*** | (2006.01) |
| ***A63B 69/36*** | (2006.01) |
| ***A63B 37/00*** | (2006.01) |

(52) U.S. Cl.
CPC ..... *A63B 43/008* (2013.01); *A63B 37/0022* (2013.01); *A63B 69/3658* (2013.01)

(58) Field of Classification Search
CPC .... A63B 37/0022; A63B 43/008; A63B 45/02
USPC ..... 473/378
See application file for complete search history.

(56) References Cited

U.S. PATENT DOCUMENTS

| | | | | |
|---|---|---|---|---|
| 3,455,027 | A | 7/1969 | Perkins | |
| 3,753,565 | A | 8/1973 | Baker | |
| 4,915,389 | A | 4/1990 | Ihara | |
| 6,422,949 | B1 * | 7/2002 | Byrne | A63B 69/3688 473/200 |
| D524,884 | S * | 7/2006 | Sano | D21/708 |
| 7,669,338 | B2 | 3/2010 | Allen, Jr. | |
| 7,691,005 | B2 | 4/2010 | Mitsuba | |
| D699,307 | S * | 2/2014 | Gardner, Jr. | D21/708 |
| 8,721,468 | B1 | 5/2014 | Barrett | |
| 2006/0293113 | A1 * | 12/2006 | Pelz | A63B 43/008 473/280 |
| 2007/0072700 | A1 | 3/2007 | Chute | |
| 2008/0020865 | A1 * | 1/2008 | Mitsuba | A63B 37/0003 473/378 |

(Continued)

OTHER PUBLICATIONS

International Search Report and Written Opinion dated Oct. 8, 2020 relating to PCT Application No. PCT/US20/43497, 14 pages.

*Primary Examiner* — Raeann Gorden
(74) *Attorney, Agent, or Firm* — Stinson LLP

(57) ABSTRACT

A golf ball alignment device includes a golf ball having an exterior surface. Indicia is disposed on the exterior surface of the golf ball. The indicia include first and second line segments extending along a portion of the golf ball at a spaced interval. The spaced interval is narrower at a first end of each line segment than at a second end of each line segment such that the line segments converge from the second end of the line segments to the first end of the line segments. The indicia provide an alignment reference on the golf ball for a user to align the line segments with at least one of an intended direction of travel of the golf ball and a club head used to strike the ball in the intended direction of travel.

19 Claims, 3 Drawing Sheets

(56) References Cited

U.S. PATENT DOCUMENTS

| | | | | |
|---|---|---|---|---|
| 2010/0095858 | A1 | 4/2010 | Krikorian | |
| 2011/0065530 | A1* | 3/2011 | Molinari ..... | A63B 69/3688 473/378 |
| 2012/0264539 | A1 | 10/2012 | Hueber | |
| 2013/0102416 | A1 | 4/2013 | Helms | |

* cited by examiner

GOLF BALL WITH INDICIA

CROSS-REFERENCE TO RELATED APPLICATION

This application claims priority to U.S. Provisional Patent Application Ser. No. 62/884,006, filed Aug. 7, 2019, which is hereby incorporated by reference in its entirety.

BACKGROUND

The present disclosure generally relates to golf balls, and more particularly to golf balls having indicia for alignment and range-finding.

Golfers often have difficulty properly aligning a putter club head with a golf ball along an intended direction of ball travel and accurately stroking the putter club head through the ball along the intended direction. If the putter is aligned and strikes the ball true, it will follow the laws of physics and move in the direction struck. It is critical to not only strike the center of the ball with the center of gravity of the putter, but also at the correct angle. Using the tangent formula, for every one degree of deviation from perpendicular, a strike of the ball will be deviated approximately 0.209 inches per foot of travel. For a ten foot putt, this translates to 2.09 inches. Thus, performance can be improved by improving the alignment of the ball relative to the target and of the putter with the ball. Also, knowing the distance to the hole and thus the amount of force needed to strike the ball to travel the necessary distance can further increase the performance of the golfer.

SUMMARY

In one aspect, a golf ball alignment device generally comprises a golf ball having an exterior surface. Indicia is disposed on the exterior surface of the golf ball. The indicia comprise first and second line segments extending along a portion of the golf ball at a spaced interval. The spaced interval is narrower at a first end of each line segment than at a second end of each line segment such that the line segments converge from the second end of the line segments to the first end of the line segments. The indicia provide an alignment reference on the golf ball for a user to align the line segments with at least one of an intended direction of travel of the golf ball and a club head used to strike the ball in the intended direction of travel.

In another aspect, a golf ball range-finding device generally comprises a golf ball having an exterior surface. Indicia is disposed on the exterior surface of the golf ball. The indicia comprise first and second line segments extending along a portion of the golf ball at a spaced interval. The indicia are configured to measure a distance from the golf ball to a target by aligning the target between the first and second line segments and rotating the golf ball until sides of the target are positioned at inner edges or tips of the first and second line segments. A location along the first and second line segments where the sides of the target are positioned at the inner edges or tips of the first and second line segments indicates the distance from the golf ball to the target.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
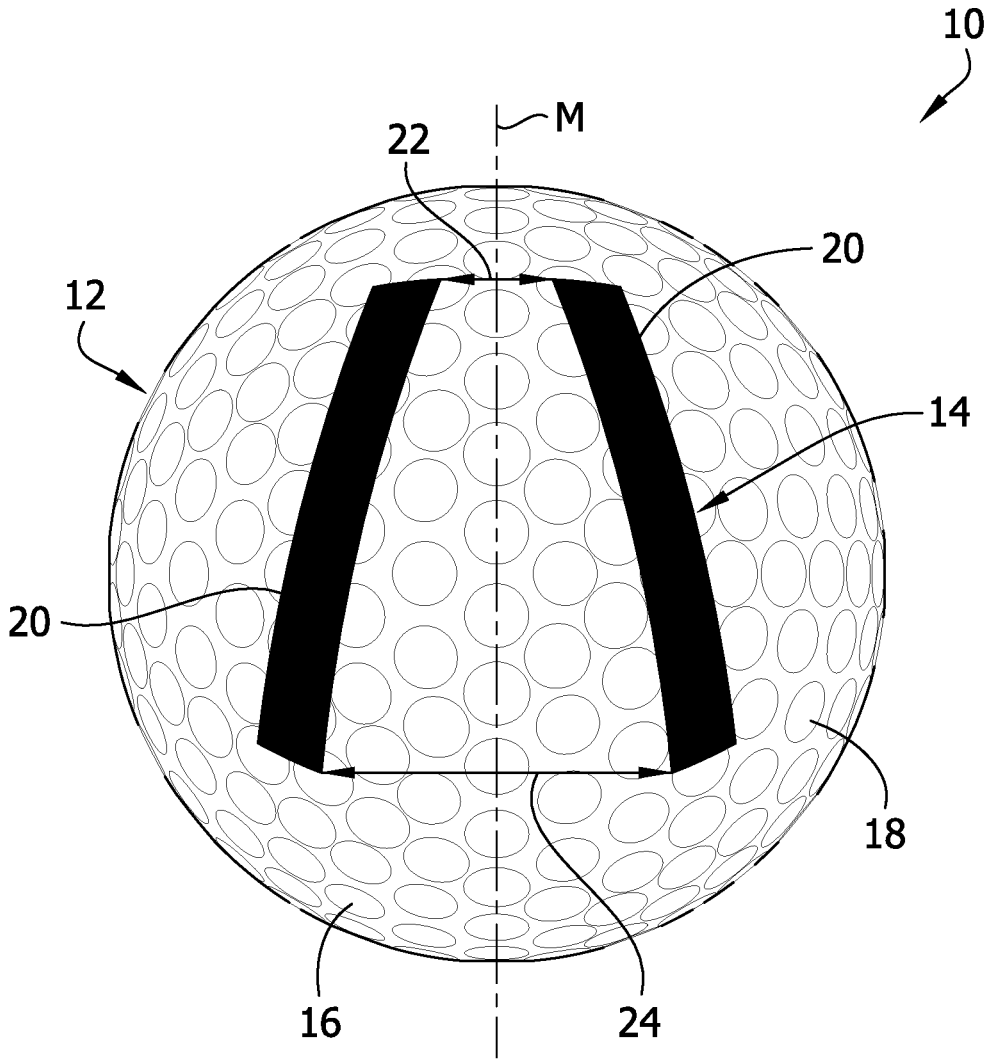
FIG. 1 is a perspective view of one embodiment of a golf ball alignment device.

Referring to FIG. 1, a golf ball alignment device is generally indicated at 10. The alignment device comprises a golf ball 12 and indicia 14 disposed on an exterior surface 16 of the golf ball for providing visibility and alignment of the golf ball. In particular, the indicia 14 provides a visible reference on the golf ball 12 to assist a golfer to more accurately align at least one of the golf ball and a club used to strike the golf ball for causing the golf ball to travel along an intended direction upon being struck by the golf club, as will be described in greater detail below. Thus, the alignment device 10 allows a golfer to align the indicia 14 with the intended direction of travel of the golf ball 12, and to align a club head of the golf club (e.g., putter) used to strike the golf ball with the indicia on the golf ball providing the correct alignment for striking the ball in the intended direction.

The golf ball 12 may be a regulation golf ball as determined by the United States Golf Association (USGA). As such, the golf ball 12 may preferably have a diameter of approximately 1.68 inches (42.7 mm) or greater, and a weight of not more than 1.62 ounces (45.93 grams) as dictated by the United States Golf Association Rules. However, those skilled in the art will recognize that a ball with a different diameter and/or weight may also be used without departing from the scope of the present disclosure. In one embodiment, the exterior surface 16 of the golf ball 12 is white. However, other colors may be used for the surface 16 of the golf ball 12 without departing from the scope of the present disclosure. Additionally, the exterior surface 16 of the golf ball 12 may have other identification markings (not shown) such as brand names and types.

The golf ball 12 comprises a generally spherical ball having a plurality of dimples 18 formed in the exterior surface 16 of the ball. The number and arrangement of dimples 18 may be different from the illustrated embodiment. Additionally, the dimples 18 may be omitted without departing from the scope of the disclosure. The generally spherical nature of the golf ball 12 is such that a hemispherical plane extends through a midline M of the golf ball dividing the golf ball into two halves or hemispheres.

The indicia 14 is printed on the exterior surface 16 of the golf ball 12. Preferably, the indicia 14 is printed on a base coat of the ball 12 with a top coat applied over the indicia, as is known in the art. However, it is within the scope of the present disclosure that the indicia 14 be printed on the top coat of the golf ball 12, or otherwise applied to the golf ball. Alternatively or in addition, the indicia 14 may be a layer added to the golf ball 12, such as tape or other material which would be adhered to the surface of the golf ball. Still other methods for applying the indicia 14 to the golf ball 12 are envisioned.

In one illustrated embodiment, the indicia 14 on the golf ball 12 includes two angled line segments or bands 20 extending around the golf ball at a spaced interval to generally form a V-shape having open ends at both ends of the line segments. The line segments 20 preferably stand out visually from the exterior surface 16 of the golf ball 12, such as by color, shading, or patterns. In the illustrated embodiment, the line segments 20 are colored red so as to be clearly distinguished from the white exterior surface 16. However, other colors or color combinations are within the scope of the present disclosure. As shown, the line segments 20 are spaced apart by a greater interval at one end than the other and do not meet thus forming a first gap 22 between the line segments at a first end of the indicia 14, and a second gap 24 between the line segments at a second end of the indicia. The second gap 24 is greater than the first gap 22 such that the line segments 20 converge toward each other from the second end of the indicia 14 to the first end of the indicia, and diverge from each other from the first end of the indicia to the second end. Thus in use, the generally V-shape indicia 14 is wide at the second end and then narrows toward the first end allowing the golfer to more easily use both eyes when aligning a shot (e.g., putt). Aiming with both eyes open allows for better special awareness thereby eliminating alignment errors by the golfer.

Additionally, the indicia 14 is centered about the midline M of the golf ball 12 such that one of the line segments 20 is disposed on one side of the midline and the other line segment is disposed on the other side of the midline. Therefore, the midline M bisects the first and second gaps 22, 24 between the line segments 20. Preferably, the indicia 14 including the line segments 20 is located generally within a center third of the diameter of the golf ball 12 extending orthogonally to the midline M. Although, it is also contemplated that the indicia 14 may be located generally within a center one-sixth of the golf ball 12. As used herein, "generally" or "about" means ±25%. Further, it is within the scope of the present disclosure that the golf ball 12 includes a different number or configuration of line segments 20. In the illustrated embodiments, the line segments 20 are generally straight continuous line segments. However, the line segments 20 could be curved line segments or a plurality of segmented line segments without departing from the scope of the disclosure. Additionally, markings other than line segments can be used such as arrows or other geometrical shapes. As such, the line segments 20 may be only a part of a larger shape. Still other markings are envisioned without departing from the scope of the disclosure.

Figure 2:
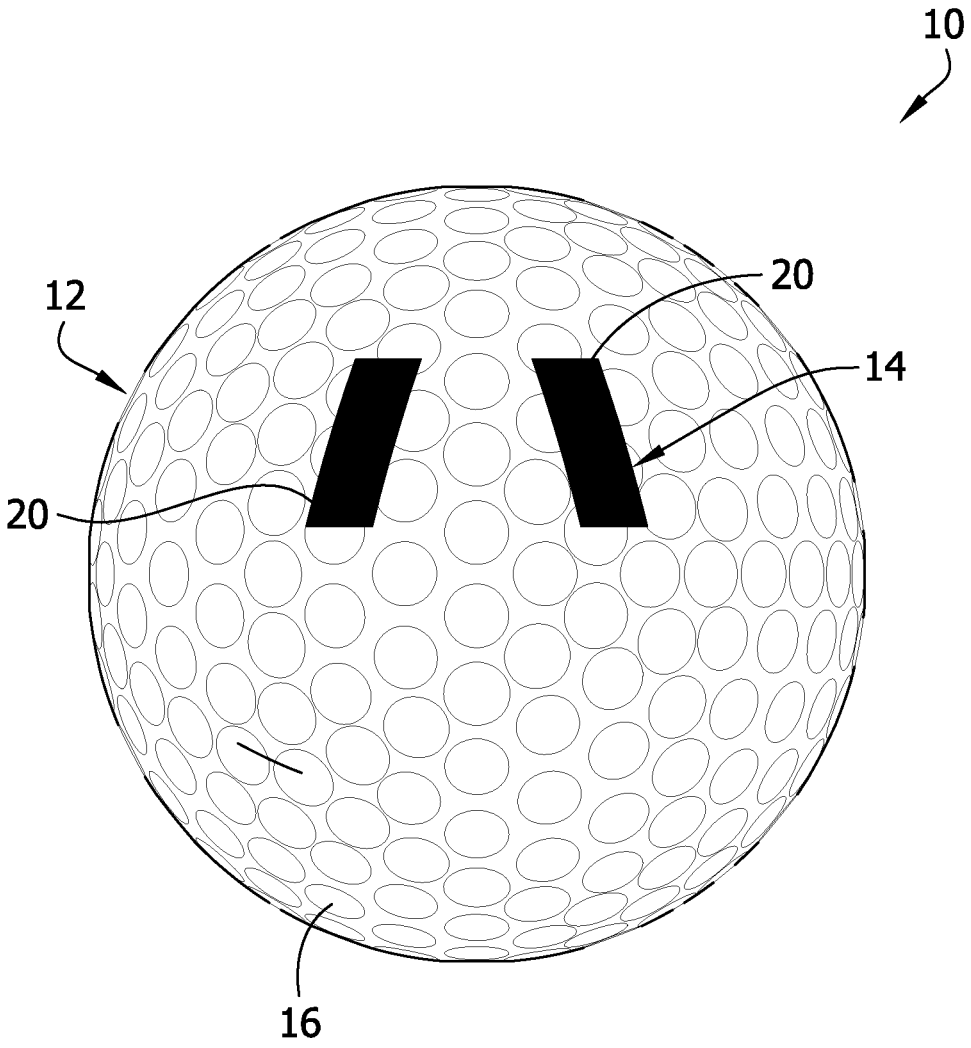
FIG. 2 is a perspective view of another embodiment of a golf ball alignment device.

In an embodiment, the line segments 20, each have a length L of about ½ inch to 1½ inches. As shown in FIG. 1, the flanks of the indicia 14, i.e., the line segments 20, have a length of about 1 inch. As shown in FIG. 2, in an alternative embodiment, line segments 20, have a length of about ½ inch. Line segments having a length longer than about 1½ inches are also envisioned within the scope of the disclosure. In one embodiment, the line segments 20 are about ¼ inch wide or less (e.g., 3⁄16 inch). However, other widths of the line segments are envisioned. The first gap 22 between the line segments 20 at the narrow, converging end of the indicia 14 may be about ¼ inch or less. In the illustrated embodiments, the two line segments 20 of the indicia 14 are mirrored about the midline M of the golf ball 12. Thus, each line segment has the same length and width. However, the line segments 20 may have different lengths and widths without departing from the scope of the disclosure. Moreover, it is to be understood that since the line segments circumscribe a spherical body, the line segments may not be completely straight line segments. However, the line segments 20 may appear to the golfer as straight line segments when applied on the rounded surface of the golf ball 12.

In the illustrated embodiments, a single indicia 14 is shown on the golf ball 12. However, multiple indicia 14 may be disposed on the golf ball 12. For instance, a second indicia 14 may be centered on the midline M and disposed at a diametrically opposite location from the illustrated indicia. The second indicia 14 may have the same or different configuration from the first indicia. For example, a shorter open-ended V-shape indicia (FIG. 2) may be applied to one side of the golf ball 12 while a longer open-ended V-shape indicia (FIG. 1) may be applied on an opposite side of the ball. Other combinations of indicia configurations are also envisioned.

In use, a golfer aligns the golf ball 12 to precisely target a hole or another selected spot on the putting surface to allow for the slope of the green. For instance, the user can align the ball 12 by pointing the end of the indicia 14 with the first gap 22 toward the hole/target such that the hole/target visually fills the narrow open ended tip of the V-shape indicia between the line segments 20. In other words, the target completes the V-shape of the indicia 14 indicating precise alignment. Current USGA rules permit leaving the flag stick in the hole during putting. Therefore, the golfer can align the golf ball 12 so that the flag stick is disposed in the middle of the first gap 22 to precisely target the flag stick. For instance, the user can align the ball 12 such that the flag stick visually fills the open ended tip (i.e., first gap 22) of the V-shape indicia 14 such that sides of the flag stick appear visually to touch inner edges and/or tips of the line segments 20 at the first end of the indicia. In other words, the flag stick completes the V-shape for precise alignment on the ½ inch flag stick. The V-shape indicia for alignment permits the golfer a much more accurate target by focusing on a ½ inch diameter flagstick instead of a 4.25 inch diameter hole. Thus, the margin of error is more likely to be contained within the diameter of the hole than if the golfer was focusing alignment on the hole in general.

Because the ball remains fixed and depends on a proper alignment with the putter to move the ball in the target direction, the target direction is more easily defined by the ball rather than the putter. In contrast, a marking on the putter tends to identify the location on the putter at which the ball should meet the putter when the ball is struck by the putter. Because the putter is in motion, there is a much greater potential for misdirection of the ball when relying on a marking on the putter when the ball is struck. Thus, the configuration of the present disclosure indicates two aspects of striking the ball: first, the narrow end of the target V indicia 14 indicates the intended direction of travel of the ball; and second, the wide end of target V indicia indicates the location on the ball at which the ball should be contacted by the club head. In an embodiment, the golfer will attempt to align the putter face perpendicular to an imaginary line extending perpendicular to the midline M of the ball 12 and bisecting the line segments 20 upon impact.

This configuration of the present disclosure also allows a golfer to remain focused and fixed on the target and, as a result, focused and fixed on the ball 12 and its intended direction. In other words, the V-shape indicia 14 inhibits the eyes from unobstructed drifting or from being distracted from focusing on the hole during alignment of the putter club head and the ball and during the striking of the ball when a golfer swings the putter. This is because the convergence of the line segments 20 draw the focus of the eyes toward the space between the narrow end of the indicia 14 which is aimed at the target. This is a significant advantage over balls having a single line marked on the ball because it has been found that golfers find it harder to remain focused and fixed on a single line. In addition, when the golf ball 12 is used in conjunction with putters which have the same, similar or complimentary markings, the accuracy of the golfer is significantly improved by improving (1) the ability of the golfer to align the ball properly with the intended target; (2) the ability of the golfer to align the putter club head with the ball so it strikes the ball in the direction of the target; and (3) the ability of the golfer to strike the ball with the putter club head as aligned prior to the actual swing so that the ball is moved more accurately in the direction of the target.

Figure 3:
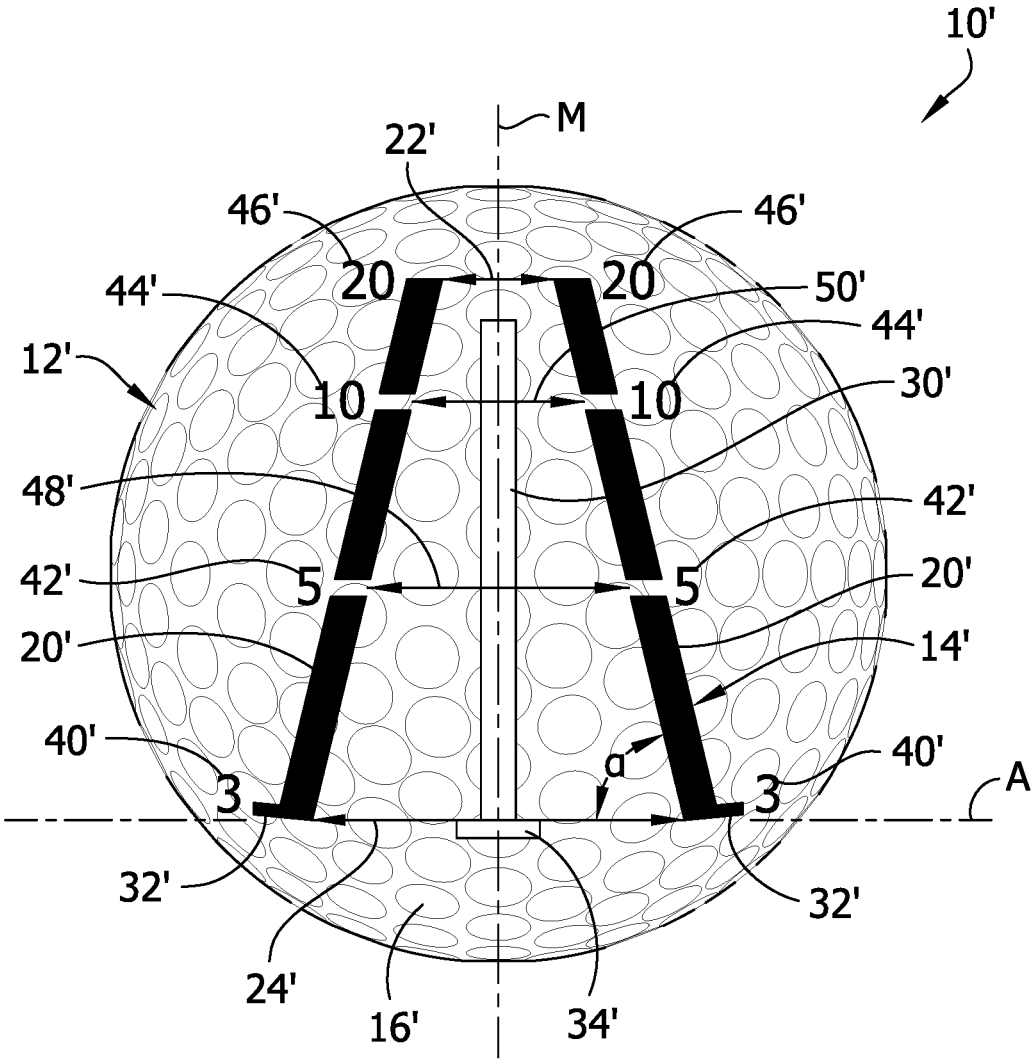
FIG. 3 is perspective view of another embodiment of a golf ball alignment and range-finding device.

Referring to FIG. 3, a golf ball alignment device of another embodiment is generally indicated at 10'. The alignment device comprises a golf ball 12' and indicia 14' disposed on an exterior surface 16' of the golf ball for providing visibility and alignment of the golf ball. The indicia 14' is similar to the indicia 14 shown in FIG. 1. The indicia 14' includes first and second angled line segments or bands 20' extending at a spaced interval to generally form a V-shape having open ends at both ends of the line segments. The indicia 14' may be printed or otherwise disposed on an exterior surface 16 of the golf ball 12'. As shown, the line segments 20 are spaced apart by a greater interval at one end than the other and do not meet thus forming a first gap 22' between the line segments at a first end of the indicia 14', and a second gap 24' between the line segments at a second end of the indicia. The second gap 24' is greater than the first gap 22' such that the line segments 20' converge toward each other from the second end of the indicia 14' to the first end of the indicia, and diverge from each other from the first end of the indicia to the second end.

The indicia 14' further includes a third line segment 30' extending between the line segments 20'. The indicia 14' can be centered about the midline M of the golf ball 12' such that the third line segment 30' is disposed on the midline and one of the first and second line segments 20' is disposed on one side of the midline and the other of the first and second line segments is disposed on the other side of the midline. As will be explained in greater detail below, the third line segment 30' assists in the aiming process. A length of the third line segment 30' is such that the third line segment is contained within an extension dimension of the first and second line segments 20' that extends parallel to the midline M of the golf ball 12'. In the illustrated embodiment, the third line segment 30' extends from the second end of the indicia 14' to a location short of the first end of the indicia. In one embodiment, the third line segment 30' is about 0.125 inches from the first end of the indicia 14'. This allows the target (e.g., flag stick) to be visually brought into the indicia 14' between the first and second line segments 20' to better align the indicia with the target. Thus, the third line segment 30' helps to further focus the eyes toward the first gap 22' between the first and second line segments 20' at the first end of the indicia 14'. The third line segment 30' may have another configuration such as an arrow or some other shape without departing from the scope of the disclosure.

Fourth and fifth line segments 32' extend from an end of the first and second line segments 20', respectively, away from the third line segment 30'. In the illustrated embodiment, the fourth and fifth line segments 32' extend from the end of the first and second line segments 20' at the second end of the indicia 14'. The fourth and fifth line segments 32' extend generally orthogonally from the midline m of the golf ball 12' and thus orthogonally to the third line segment 30'. The fourth and fifth line segments 32' provide an indication of a direction of contact for a golf club (e.g., putter) to contact the golf ball. In particular, the fourth and fifth line segments 32' are aligned along a club alignment axis A that extends perpendicular to the third line segment 30' and midline M of the golf ball 12'. A sixth line segment 34' extend laterally from an end of the third line segment 30' in opposite directions toward the first and second line segments 20'. The sixth line segment 34' is also aligned along the club alignment axis A to provide an additional reference for properly aligning the club for hitting the golf ball 12'.

Therefore, in use, a user will align the golf ball 12' by pointing the end of the indicia 14' with the first gap 22' toward the hole/target such that the hole/target visually fills the narrow open ended tip of the V-shape indicia between the first and second line segments 20'. The user may use the third line segment 30' to focus their view to the center of the indicia 14' between the first and second line segments 20' and to position the third line segment at the center of the target for precise alignment of the ball 12' with the target. The user can then place the golf ball 12' on the ground maintaining the alignment of the ball with respect to the hole/target. The user then aligns a face of the putter with respect to the fourth, fifth, and sixth line segments 32',34' so that the face of the putter is parallel to the fourth, fifth, and sixth line segments. This promotes contact of the putter face with the golf ball 12' where the putter face is generally parallel to the fourth, fifth, and nixed line segments 32',34' so that the force created on the golf ball will be perpendicular to the fourth, fifth, and sixth line segments and therefore parallel to the third line segment 30' such that the ball will be directed in line with the intended target. Accordingly, the indicia 14' aids in lining up the golf ball 12' for being putted on a putting green.

In one embodiment, the first and second line segments 20' may be colored blue and the third line segment 30' may be colored red so as to be clearly distinguished from the white exterior surface 16' of a golf ball 12'. However, other colors or color combinations are within the scope of the present invention.

Additionally, markings are spaced along the length of the first and second line segments 20'. The markings are positioned to provide an indication of a distance from the golf ball 12' to the target based on a visual perception of the target in relation to the spacing between the first and second line segments 20. A first marking 40' is disposed at the second end of the first and second line segments 20' and provides a first distance indication. A second marking 42' is disposed at an intermediate location along the first and second line segments 20' and provides a second distance indication. A third marking 44' is disposed at an intermediate location along the first and second line segments 20' between the second marking 42' and the first end of the line segments and provides a third distance indication. A fourth marking 46' is disposed at the first end of the first and second line segments 20' and provides a fourth distance indication. Additional or fewer marking may be included without departing from the scope of the disclosure.

In one embodiment, the first marking 40' provides a distance indication that the target is about 3 feet (91 cm) away, the second marking 42' provides a distance indication that the target is about 5 feet (152 cm) away, the third marking 44' provides a distance indication that the target is about 10 feet (305 cm) away, and the fourth marking 46' provides a distance indication that the target is about 20 feet (610 cm) away. The markings may provide other distance indications without departing from the scope of the disclosure. In the illustrated embodiment, the markings comprise numbers. However, the markings could have other forms without departing from the scope of the disclosure.

The indicia 14' uses the geometry of the triangle formed by the line segments of the indicia 14' and the geometric principle of similar triangles to determine a distance of a target from the golf ball. The length and spacing of the line segments define parts of a triangle having a given size and dimension. In the illustrated embodiment, the first and second line segments 20' define sides of the triangle, and the sixth line segment 34' defines a bottom of the triangle. In one embodiment, a spacing (i.e., second gap 24') between the second ends of the first and second line segments 20' is about 0.75 inches. This defines the dimension of the base of the triangle. Each of the first and second line segments 20' has a length of about 1.4 inches and extend at an angle $\alpha$ of about 70 degrees to the base of the triangle as defined by the sixth line segment 34'. Therefore, a geometrical triangle is formed by the indicia 14'.

Based on the assumption that the user will about 3 feet (914.4 mm) behind the golf ball when making the measurement, and a flag stick diameter of about 0.75 inches (19.05 mm), the principle of similar triangles predicts how far the flag stick is from the golf ball 12' by positioning the golf ball so that flagstick completes the triangle formed by the indicia 14'. The user performs this range-finding process by centering the flag stick on the third line segment 30' between the first and second line segments 20'. The user then rotates the golf ball until the sides of the flag stick appear to touch the inner edges and/or tip of the first and second line segments 20'. The location along the first and second line segments 20' can be referenced with the markings 40'-46' on the line segments to determine the distance to the flag stick.

Therefore, the principle of similar triangles predicts that if the flag stick is used as the target and the user is about 3 feet away from the golf ball, the indicia 14' will determine that the flag stick is about 3 feet away when the users holds the ball in alignment with the flag stick such that the sides of the flag stick appear visually to touch the inner edges and/or tip of the first and second line segments 20'. This location will be at the base of the triangle where the first marking 40' is located. As such, the flag stick will appear to make a line across the indicia 14' at the location of the first marking 40'.

The additional markings 42'-46' of the indicia 14' determine the distance of the flag stick from the golf ball in the same way. With the flagstick aligned with the third ling segment 30' between the first and second line segments 20', the distance of the ball from the flag stick may require the user to rotate the golf ball until the sides of the flag stick appear to touch the inner edges and/or tip of the first and second line segments. Depending on the distance to the flag stick, this will be at different locations along the first and second line segments 20'. The alignment and positioning of the flag stick completes the similar triangle on the indicia 14' and through that geometrical principle the distance to the flag stick can be calculated.

As will be understood, the perceived width of an object decreases the further the object is away. Therefore, the flag stick will appear thinner the further the user stands from the flag stick. This is matched by the gap between the first and second line segments 20' decreasing from the second to the first end of the indicia 14'. This phenomenon is use to estimate the distance to the flag stick. In the illustrated embodiment, the second marking 42' is located about 0.46 inches from the base of the triangle as measured along a dimension parallel to the third line segment 30'. A gap 48' between the first and second line segments 20' at the second marking 42' is about 0.45 inches. In the illustrated embodiment, the third marking 44' is located about 0.83 inches from the base of the triangle as measured along a dimension parallel to the third line segment 30'. A gap 50' between the first and second line segments 20' at the third marking 44' is about 0.22 inches. In the illustrated embodiment, the fourth marking 46' is located about 1 inch for the base of the triangle as measured along a dimension parallel to the third line segment 30'. A spacing (i.e., first gap 22') between the first and second line segments 20' at the fourth marking 46' is about 0.11 inches.

The size and shape of the triangle formed by the indicia 14' provide for distance measurements between about 3 feet and about 20 feet. However, it will be understood that the indicia 14' can be configured to determine other target distances based on the size and shape of the indicia 14'.

The indicia 14' thus provides the ability to accurately align the golf ball 12' with the intended target and estimate a distance to the target to provide an indication to the user of the amount of force needed to exert on the golf ball with the golf club for the golf ball to reach the target. This process is done by aligning the target within the first and second line segments 20' and rotating the golf ball 12' until the target completes the triangle formed by the indicia 14'. The golf ball 12' can be further aligned by centering the target on the third line segment 30' of the indicia 14'. The fourth, fifth, and sixth line segments 32',34' can then be used to properly align the face of the golf club for hitting the golf ball 12' in the intended direction.

Additionally, one or more golf balls 12' may be provided in a package or sleeve (not shown). The sleeve may also include instructions for using the alignment device as described above.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

Not all of the depicted components illustrated or described may be required. In addition, some implementations and embodiments may include additional components. Variations in the arrangement and type of the components may be made without departing from the spirit or scope of the claims as set forth herein. Additional, different or fewer components may be provided and components may be combined. Alternatively or in addition, a component may be implemented by several components.

The above description illustrates the invention by way of example and not by way of limitation. This description enables one skilled in the art to make and use the invention, and describes several embodiments, adaptations, variations, alternatives and uses of the invention, including what is presently believed to be the best mode of carrying out the invention. Additionally, it is to be understood that the invention is not limited in its application to the details of construction and the arrangement of components set forth in the following description or illustrated in the drawings. The invention is capable of other embodiments and of being practiced or carried out in various ways. Also, it will be understood that the phraseology and terminology used herein is for the purpose of description and should not be regarded as limiting.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A golf ball alignment device comprising:

a golf ball having an exterior surface;

indicia disposed on the exterior surface of the golf ball, said indicia comprising first and second line segments extending along a portion of the golf ball at a spaced interval, wherein the spaced interval is narrower at a first end of each line segment than at a second end of each line segment such that the line segments converge from the second end of the line segments to the first end of the line segments, said indicia providing an alignment reference on the golf ball for a user to align the line segments with at least one of an intended direction of travel of the golf ball and a club head used to strike the ball in the intended direction of travel; and markings spaced along a length of at least one of the first and second line segments, the markings providing an indication of a distance to a target when a target is aligned between the first and second line segments such that a target completes a triangle partially formed by the first and second line segments, the indication of the distance to a target being based on the principle of similar triangles.

2. The alignment device of claim 1, wherein the first and second line segments are at least one from the group consisting of colored, patterned, and shaded identically.

3. The alignment device of claim 1, wherein the indicia include a third line segment disposed between the first and second line segments.

4. The alignment device of claim 3, wherein the golf ball has a midline, the third line segment extending along the midline, the first and second line segments being disposed on opposite sides of the midline.

5. The alignment device of claim 4, wherein the indicia includes a fourth line segment extending laterally from the first line segment orthogonally to the midline, and a fifth line segment extending laterally from the second line segment orthogonally to the midline.

6. The alignment device of claim 1, wherein a distance between the first and second line segments at the first ends of the first and second line segments is not more than about 0.25 inches (0.64 cm).

7. The alignment device of claim 6, wherein a distance between the first and second line segments at the second ends of the first and second line segments is more than about 0.5 inches (1.27 cm).

8. The alignment device of claim 1, wherein the markings provide at least three distance indications.

9. The alignment device of claim 1, wherein a target is a flagstick, the indicia being configured to measure a distance from the golf ball to a flagstick by aligning a flagstick between the first and second line segments and rotating the golf ball until sides of a flag stick are positioned at inner edges or tips of the first and second line segments, wherein a location along the first and second line segments where the sides of a flag stick are positioned at the inner edges or tips of the first and second line segments indicates the distance from the golf ball to a flagstick.

10. The alignment device of claim 1, wherein the indicia include another line segment extending orthogonally to a midline of the golf ball.

11. A golf ball range-finding device comprising:

a golf ball having an exterior surface;

indicia disposed on the exterior surface of the golf ball, said indicia comprising first and second line segments having inner edges or tips at ends of the segments and extending along a portion of the golf ball at a spaced interval, said indicia being configured to measure a distance from the golf ball to a target by aligning a target between the first and second line segments and rotating the golf ball until sides of a target are positioned at the inner edges or tips of the first and second line segments, wherein a location along the first and second line segments where the sides of a target are positioned at the inner edges or tips of the first and second line segments indicates a distance from the golf ball to a target; and markings spaced along a length of at least one of the first and second line segments, the markings providing an indication of a distance to a target when a target is aligned between the first and second line segments.

12. The range-finding device of claim 11, wherein the marking provides at least three distance indications.

13. The range-finding device of claim 11, wherein the markings indicate distances to a target between about 3 feet (91 cm) and about 20 feet (610 cm).

14. The range-finding device of claim 13, wherein the indicia include a first marking indicating a distance of about 3 feet (91 cm) to a target, a second marking indicating a distance of about 5 feet (152 cm) to a target, a third marking indicating a distance of about 10 feet (305 cm) to a target, and a fourth marking indicating a distance of about 20 feet (610 cm) to a target.

15. The range-finding device of claim 11, wherein the golf ball has a midline, the indicia including a third line segment extending along the midline, the first and second line segments being disposed on opposite sides of the midline.

16. The range-finding device of claim 15, wherein the indicia includes a fourth line segment extending laterally from the first line segment orthogonally to the midline of the golf ball, and a fifth line segment extending laterally from the second line segment orthogonally to the midline of the golf ball.

17. The range-finding device of claim 11, wherein a distance between the first and second line segments at first ends of the line segments is not more than about 0.25 inches (0.64 cm).

18. The range-finding device of claim 17, wherein a distance between the first and second line segments at second ends of the line segments is more than about 0.5 inches (1.27 cm).

19. The alignment device of claim 1, wherein the indication of the distance to a target is based on the assumption that a user is about 3 feet behind the golf ball and a target having a diameter of about 0.75 inches (19.05 mm).

* * * * *